US005531610A

United States Patent [19]

Chen

[11] Patent Number: 5,531,610

[45] Date of Patent: Jul. 2, 1996

[54] CONNECTING MECHANISM FOR BULB HOLDER AND SOCKET

[76] Inventor: Chen Y. Chen, No. 191, Gi Yang Road, Hsin Chu, Taiwan

[21] Appl. No.: 224,756

[22] Filed: Apr. 8, 1994

[51] Int. Cl.[6] ..... H01R 13/627

[52] U.S. Cl. ..... 439/356; 439/619

[58] Field of Search ..... 313/51, 318; 362/226, 362/249, 238; 439/356, 611–619, 656, 699

[56] References Cited

U.S. PATENT DOCUMENTS

| | | | |
|---|---|---|---|
| 3,104,924 | 9/1963 | Capel | 439/619 |
| 3,233,207 | 2/1966 | Ahroni et al. | 439/619 X |
| 4,999,751 | 3/1991 | Chen | 439/356 X |
| 5,137,465 | 8/1992 | Chwang | 439/356 |
| 5,278,741 | 1/1994 | Ehrman | 439/619 X |
| 5,372,525 | 12/1994 | Wu et al. | 439/699 X |

*Primary Examiner*—Khiem Nguyen
*Attorney, Agent, or Firm*—Andrus, Sceales, Starke & Sawall

[57] ABSTRACT

An improved connecting mechanism for a bulb holder and a socket includes a latch member which is one part of the bulb holder and a securing seat which is one part of the socket. The latch member includes a boss which extends horizontally from the outer wall of the flange of the tubular body of the bulb holder. A hooking rod extends from the underside of the boss to a preset length. A slightly enlarged bead is provided at the end of the hooking rod. The securing seat includes a projected portion extended from the top of the outer wall of the tubular body of the socket. The projected portion further includes a securing channel for receiving the hooking rod. The inner diameter of the securing channel is slightly smaller than the hooking rod in such a manner that an interference fit is reached therebetween.

2 Claims, 4 Drawing Sheets

B-B'

CONNECTING MECHANISM FOR BULB HOLDER AND SOCKET

FIELD OF THE INVENTION

This invention relates to a connecting mechanism, particular to an improved mechanism for a bulb holder and socket connecting which facilitates an effective engagement therebetween while decreasing the manufacturing cost.

DESCRIPTION OF THE PRIOR ART

The light strings have been widely used in our daily lives, specially in decorating the Christmas tree because it creates a warm and heartful atmosphere to all the people. On the other hand, decorating the building with light strings becomes more and more popular.

Since the light strings are made from plastic material, they are easily effected by the environments, especially the temperature. Under this situation, many bulb holders were separated from the socket when the temperature becomes lower. Accordingly, the bulb holder falls down from its socket. Because the bulbs are connected in series, even one lost bulb will place all the light strings in a malfunctioning condition. The repair is inconvenient and cost high.

Many improvement or measurement have been introduced to the bulb holder and its socket to prevent the bulb holder from dropping off and indeed they work well.

For example, Carpel U.S. Pat. No. 3,104,924; Moranduzzo U.S. Pat. No. 3,371,306 Van Sicker U.S. Pat. No. 4,679,126; Kelner U.S. Pat. No. 4,803,396; Tseng U.S. Pat. No. 4,970,632; Stefanelli U.S. Pat. No. 5,001,615 and Chuang U.S. Pat. No. 5,137,465 of all teach a subject matter to solve the above described problem and no doubt they reach a certain result.

Among those references, Stefanelli's patent is relatively simple and it teaches "A lamp base/husk assembly comprise an elongate lamp base and an elongate husk configured and dimensioned to receive coaxially and telescopically therein (and to release therefrom) a portion of the lamp base. A lug-and locking element combination, integral in part with the lamp base and in part with the husk, is provided for effecting a positive interlock of the lamp base and the husk in a coaxial and telescoped disposition (and for releasing such interlock ) by a manual movement independent of the manual movement required to effect receipt of the lamp base and husk in the coaxial and telescoped disposition (or the separation of the lamp base and husk therefrom). In its preferable embodiment, a post 30 extends horizontally from the edge of said husk and a clip 40 having a clip aperture 50 extends horizontally from the edge of said lamp base. When the clip 40 is folded down, an interlock is constructed between the free end 32 of said post 30 and the clip aperture 50 of said clip 40." No doubt Steffnelli's patent can readily prevent said lamp base from escaping from said husk when an interlock is built between said clip 40 and said post 30. But the combination is relatively complicated and renders the manufacturing cost high.

On the other hand, Chuang's patent is really an excellent design, the bulb holder and socket can be readily connected by means of the post and the slot. But the manufacturing cost is quite high.

In view of manufacturing cost and assembling procedure, those above described subject matters are not economic since the configuration of the connecting mechanism is quite complicated.

SUMMARY OF THE INVENTION

It is the object of this invention to provide an improved connecting mechanism for a bulb holder and socket which facilitates an effective engagement therebetween and a simple construction. The bulb holder is tightly locked and retained within the socket.

In order to achieve the object set forth, the improved connecting mechanism for bulb holder and socket comprises a socket defining a tubular wall and a bottom. Said bottom has an opening for receiving a pair of conducting wires therethrough. A receiving chamber further includes a seat member. A pair of conducting plates are disposed inside said receiving chamber and have an electrical connection with said conducting wires respectively. A bulb holder defines a tubular wall and a bottom. Said bulb holder bottom has two openings for extending a pair of bulb legs respectively. A connecting mechanism is provided to attach the bulb holder to the socket in such a manner that the bulb legs are engaged with said conducting plates respectively. The connecting mechanism includes a securing seat which is one part of-the socket and a latching member which is one part of the bulb holder.

BRIEF DESCRIPTION OF THE DRAWINGS

The structural and operational characteristics of the present invention and its advantages as compared to the known state of the prior art will be better understood from the following description, relating to the attached drawings which show illustratively but not restrictively an example of an improved connecting mechanism for bulb holder and socket. In the drawings.

DETAILED DESCRIPTION OF PREFERABLE EMBODIMENT

Figure 1:
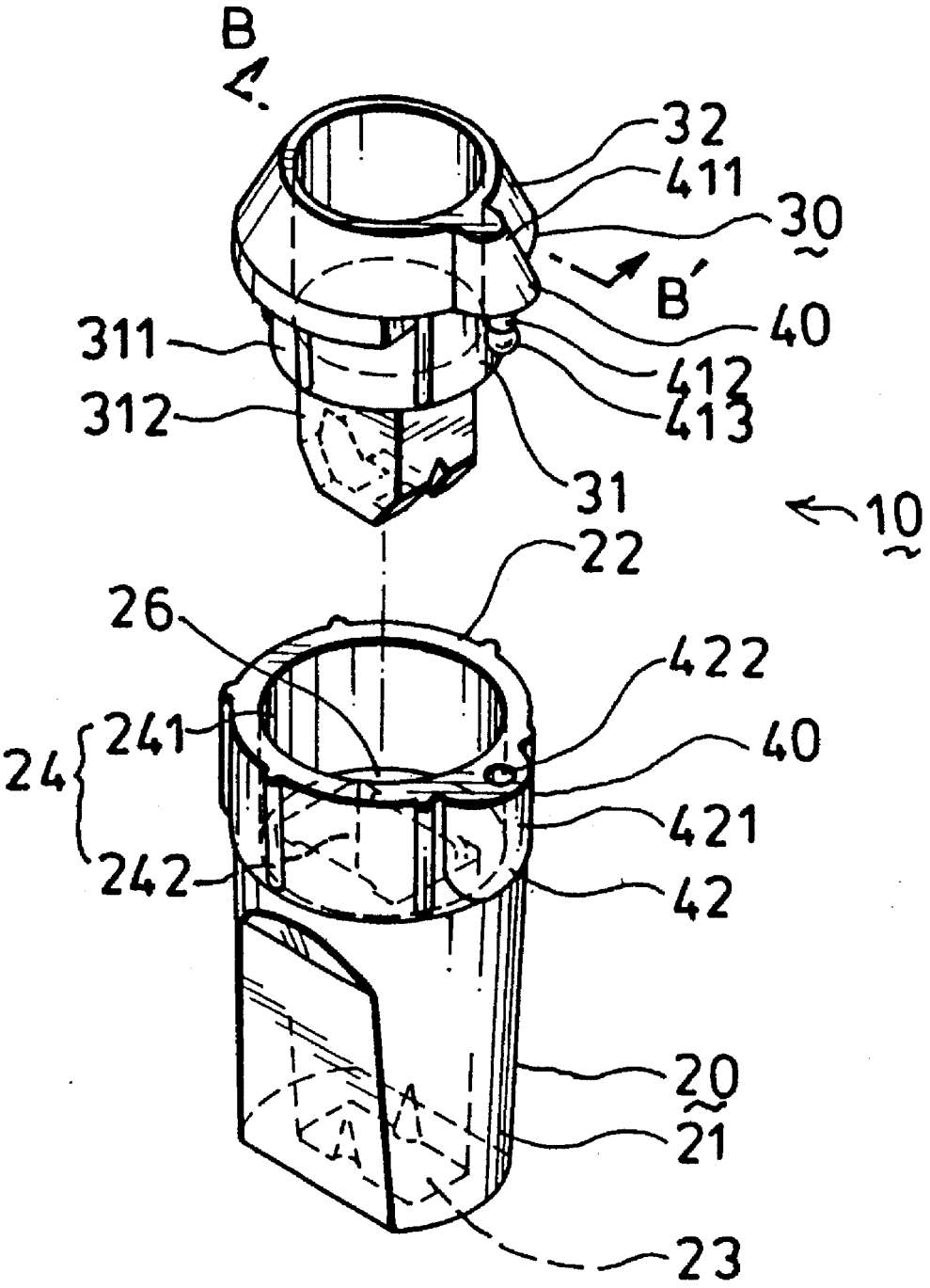
FIG. 1 is a perspective view of the bulb holder and socket incorporated with an improved connecting-mechanism made according to the present invention.
Figure 2:
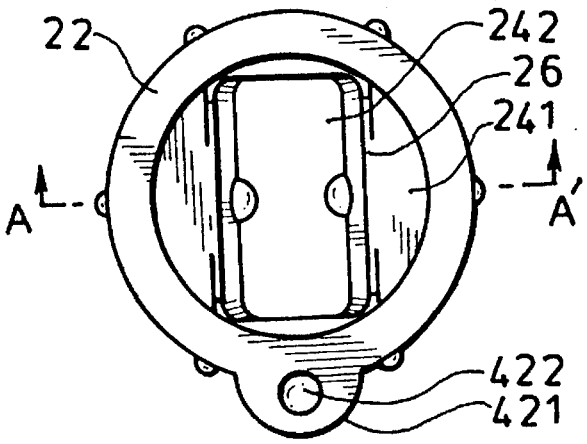
FIG. 2 is a top plan view of the socket.
Figure 2A:
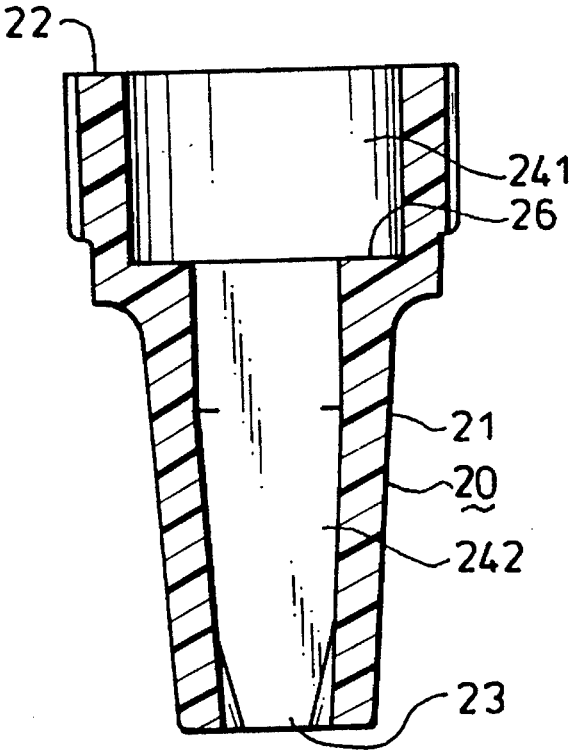
FIG. 2A is a cross sectional view of the socket taken from A—A line of FIG. 2.
Figure 3:
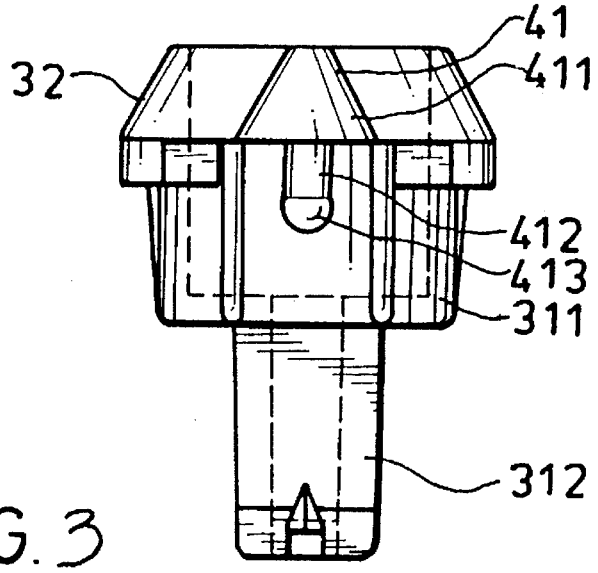
FIG. 3 is a front plan view of the bulb holder.
Figure 3A:
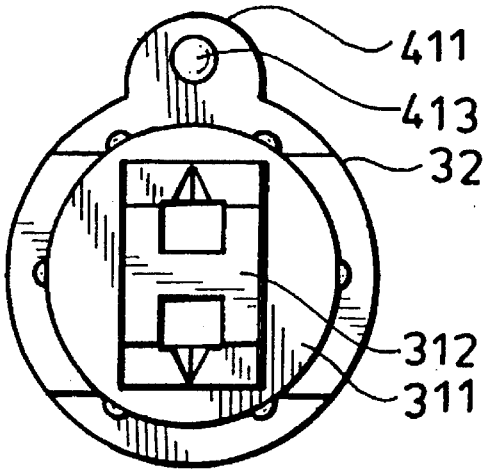
FIG. 3A is a bottom plan view of the bulb holder.
Figure 4:
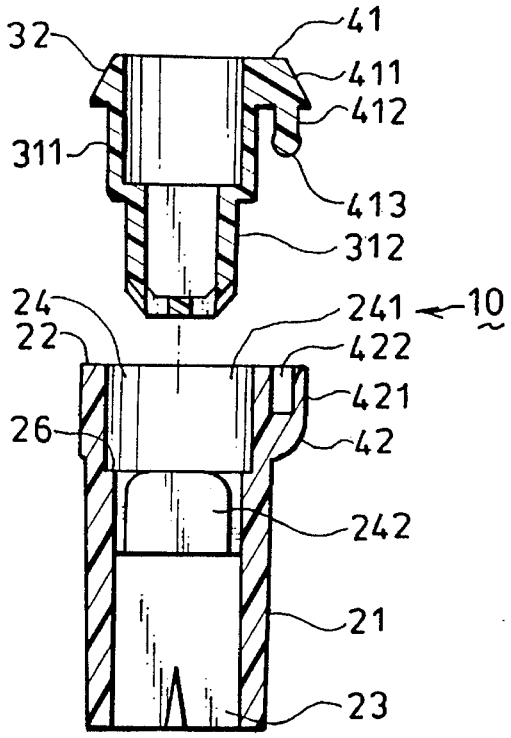
FIG. 4 is a cross sectional view of the bulb holder and socket separated from each other.

Referring to FIGS. 1,2, 2A, 3, 3A and 4, the improved connecting mechanism for the bulb support and socket 10 comprises a socket 20 having a tubular body 21. An opening 22 is defined at the top and a passage 23 is provided at the bottom for receiving a pair of conducting wires therethrough. A receiving chamber 24 is defined within the tubular body 21. The receiving chamber 24 includes a first chamber 241 which has a circular cross section and a second chamber 242 which has a rectangular cross section. The second chamber 242 is located below the first chamber 241 and both are partitioned by a step 26. The second chamber 242 is in communication with the passage 23 of the tubular body 21. A pair of conducting plates (not shown in FIG. 1) are disposed inside the second chamber 242.

A bulb holder 30 has a tubular body 31. The top of the tubular body 31 is provided with a flange 32 which extends to the same diameter as the tubular body 21 of the socket 20.

The tubular body 31 can be coaxially and removable received into the receiving chamber 24 of the tubular body 21. A bulb (not shown in the figure) can be disposed within the tubular body 31. The tubular body 31 has a first body 311 which has a circular cross section and a second body 312 which has a rectangular cross section. The first body 311 and the second body 312 can be received by the first chamber 241 and the second chamber 242 respectively. The tubular body 31 is also provided with a passage for conducting wires.

When the bulb holder 30 is removably and coaxially received by the socket 20, the first body 311 is against the step 26 of the socket 20 in such a manner that the flange 32 of the bulb holder 30 defines a distance with the opening 22 of the socket 20.

In order to attach and retain the bulb holder 30 to the socket 20, a connecting mechanism 40 is provided. The connecting mechanism 40 includes a latch member 41 which is also one part of the bulb holder 30 and a securing seat 42 which is also one part of the socket 20. When the bulb holder 30 is removably and coaxially attached to the socket 20, the latch member 41 is engaged and retained by the securing seat 42. The detail of the connecting mechanism 40 is described below.

The latch member 41 includes a boss 411 which extends horizontally from the outer wall of the flange 32 of the tubular body 31. A hooking rod 412 extends from the underside of the boss 411 to a preset length. A slightly enlarged bead 413 is provided at the end of hooking rod 412.

The securing seat 42 includes a projected portion 421 extended from the top of the outer wall of the tubular body 21. The projected portion 421 further includes a securing channel 422 for receiving the hooking rod 412. The inner diameter of the securing channel 422 is slightly smaller than the hooking rod 412 in such a manner that an interference fit is reached therebetween. Accordingly, the bulb holder 30 is retained in the socket 30 by the interference fit between the hooking rod 412 and the securing channel 422.

Figure 5:
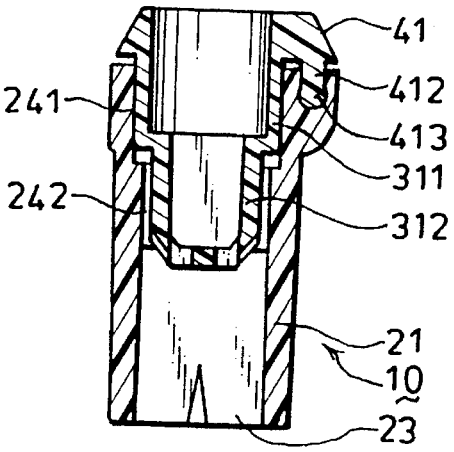
FIG. 5 is a cross sectional view showing the bulb holder attached to the socket.

As shown in FIG. 5, when the bulb holder 30 is removably and coaxially attached to the socket 20, the hooking rod 412 is retained within the securing channel 422. Accordingly, the bulb holder 30 is retained from being removed from the socket 30 even when the bulb holder and socket 10 are exposed to in cold or snow weather.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claims.

I claim:

1. An improved light bulb holder and socket comprising:

a socket having a tubular body, an opening being defined at a top of said tubular body of said socket and a passage being provided at a bottom of the tubular body of said socket for receiving a pair of conducting wires therethrough, a receiving chamber being defined within said tubular body of said socket, said receiving chamber including a first chamber adjacent said top of said tubular body of said socket having a circular cross section and a second chamber adjacent the bottom of said tubular body of said socket having a rectangular cross section, said second chamber being partitioned from said first chamber by a step, said second chamber being in communication with the passage of said tubular body of said socket, a pair of conducting plates being disposed inside said second chamber and connected to said conducting wires;

a bulb holder having a tubular body for receiving a light bulb, a top of the tubular body of said bulb holder being provided with a flange which extends to the same diameter as said tubular body of said socket, said tubular body of said bulb holder being coaxially and removable received in said receiving chamber of said tubular body of said socket, said tubular body of said bulb holder having a first body portion adjacent said top of said tubular portion of said bulb holder which has a circular cross section and a second body portion adjacent a bottom of said tubular portion of said bulb holder which has a rectangular cross section, said first and second body portions being partitioned by a shoulder, said first and second body portions being received by said first chamber and said second chamber of said socket, respectively, to electrically connect the light bulb to said conducting plates, said bulb holder being positioned with respect to said socket by the abutment of said shoulder of said bulb holder with said step of said socket so that said flange of said bulb holder is spaced from the top of said tubular body of said socket; and a connecting mechanism for removably attaching said bulb holder to said socket, said connecting mechanism including a latch member including a boss which extends radially from the exterior of the flange of said tubular body of said bulb holder, a securing rod which has a preset length provided at an underside of said boss to extend along the exterior of said tubular body of bulb holder in a direction toward the bottom thereof; and a securing seat including a projected portion extending from the top of the outer wall of said tubular body of said socket, said projected portion having a securing bore for receiving a portion of said securing rod to attach said bulb holder to said socket, said bore surrounding the portion of the securing rod inserted therein.

2. An improved light bulb holder and socket as recited in claim 1, wherein an enlarged bead is provided at a tip of said securing rod, said enlarged bead having a dimension, normal to the direction in which said securing rod is received in said securing bore, greater than a dimension of said securing hole normal to the direction in which said securing rod is received in said securing bore, so that an interference fit is achieved between said securing rod and said securing bore.

* * * * *